US008016688B2

(12) United States Patent
Gobush

(10) Patent No.: US 8,016,688 B2
(45) Date of Patent: Sep. 13, 2011

(54) METHOD AND APPARATUS FOR MEASURING BALL LAUNCH CONDITIONS

(75) Inventor: William Gobush, North Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 937 days.

(21) Appl. No.: 11/203,149

(22) Filed: Aug. 15, 2005

(65) Prior Publication Data

US 2007/0060410 A1 Mar. 15, 2007

(51) Int. Cl.
*A63B 69/36* (2006.01)
*A63F 13/00* (2006.01)

(52) U.S. Cl. ..... 473/131; 473/140; 473/151; 473/200; 473/199; 473/198; 463/2; 463/3

(58) Field of Classification Search ..... 463/2, 3; 473/140, 131, 200, 151, 199, 198
See application file for complete search history.

(56) References Cited

U.S. PATENT DOCUMENTS

| | | | | |
|---|---|---|---|---|
| 5,449,891 | A * | 9/1995 | Giebel | 235/462.31 |
| 5,471,383 | A | 11/1995 | Gobush et al. | 364/410 |
| 5,868,578 | A * | 2/1999 | Baum | 434/247 |
| 6,042,492 | A | 3/2000 | Baum | 473/453 |
| 6,390,934 | B1 * | 5/2002 | Winfield et al. | 473/351 |
| 6,533,674 | B1 | 3/2003 | Gobush | 473/199 |
| 6,592,465 | B2 * | 7/2003 | Lutz et al. | 473/198 |
| 6,721,446 | B1 * | 4/2004 | Wilensky et al. | 382/162 |
| 6,758,759 | B2 | 7/2004 | Gobush et al. | 473/131 |
| 6,781,621 | B1 | 8/2004 | Gobush et al. | 348/157 |
| 7,273,427 | B2 * | 9/2007 | Inoue et al. | 473/407 |

FOREIGN PATENT DOCUMENTS

| | | | |
|---|---|---|---|
| GB | 2 409 416 | A | 6/2005 |
| JP | 2004-195240 | | 7/2004 |
| JP | 2005-210666 | | 8/2005 |
| WO | WO 03/067524 | A2 | 2/2003 |
| WO | WO 2005/011823 | | 2/2005 |
| WO | WO 2006/061810 | A1 | 6/2006 |

OTHER PUBLICATIONS

U.S. Appl. No. 10/929,400.
U.S. Appl. No. 10/898,584.
U.S. Appl. No. 10/861,443.
U.S. Patent Publication No. 2002/0085213 A1.

* cited by examiner

*Primary Examiner* — Peter DungBa Vo
*Assistant Examiner* — Jeffrey Wong
(74) *Attorney, Agent, or Firm* — Murphy & King, P.C.

(57) ABSTRACT

A method and apparatus for measuring ball launch conditions is disclosed. Specifically, the accuracy of the calculations used to determine the kinematic characteristics may be increased. A background image of a field of view, without a golf ball present, may be acquired. Two or more images of a golf ball in motion are then be acquired based on positive or negative imaging. The background image is subtracted from each of the two or more images of the golf ball. After subtracting the background image, the two or more images of the golf ball are analyzed to determine the location of the circular perimeter of the golf ball. Based on the location of the circular perimeter of the golf ball, the location of the center of the golf ball may be calculated. Knowing the location of the center of the golf ball increases the accuracy of measurements of kinematic characteristics such as sidespin, backspin, velocity, and launch angle.

18 Claims, 5 Drawing Sheets

METHOD AND APPARATUS FOR MEASURING BALL LAUNCH CONDITIONS

FIELD OF THE INVENTION

The present invention relates to golf ball monitoring devices. More particularly, the present invention relates to an improved method and apparatus for measuring ball launch conditions.

BACKGROUND OF THE INVENTION

Golf players are continuously searching for better equipment with the ultimate goal of using that equipment to improve their game by lowering their score. However, because the mechanics of swinging a golf club are complicated, there is significant room for error. In order for a golfer to improve their swing, they must be able to swing a club consistently in an appropriate manner. Often, golfers need the assistance of a coach in order to attain a consistent swing that strikes the golf ball in a desirable manner. The human eye, however, has its limits. In order to provide more information to golfers, golf equipment manufacturers have invented ball monitoring devices, commonly referred to as "launch monitors." Launch monitors are capable of providing golfers with a more detailed swing analysis than is capable with the naked eye. A launch monitor is capable of monitoring the motion of both golf clubs and golf balls shortly before, during, and after impact. By monitoring the golf ball shortly before and after impact, launch monitors are able to approximate the trajectory and other kinematic characteristics of the golf ball, such as its spin, launch angle, and velocity.

Launch monitors typically include one or two cameras that are capable of acquiring images of the ball, club, or both simultaneously. In order to more accurately calculate the kinematic characteristics of the golf ball, each golf club and/or ball has several markers placed on its surface. The markers are typically placed such that they are all visible to the one or more cameras. Once the images are acquired, the change in position of the markers may be analyzed in order to determine desired club and/or ball characteristics. The calculation of these characteristics is typically based on mathematical algorithms, which include several unknown variables.

A continuing need exists for a method and apparatus that is capable of reducing the number of unknown variables involved in the calculation of the kinematic characteristics of a golf ball during flight. Accordingly, the present invention relates to a method and apparatus that is capable of reducing the number of unknown variables in order to provide more accurate information about the flight of a golf ball.

SUMMARY OF THE INVENTION

The present invention relates to a method and apparatus that is capable of reducing the number of unknown variables involved in the calculation of the kinematic characteristics of a golf ball during flight. In one embodiment, the present invention comprises an apparatus that includes an illumination device selectively positioned to illuminate a field of view with light within a predetermined wavelength range, a golf ball having a surface that reflects light within the predetermined wavelength range, and a background surface that absorbs the light within the predetermined wavelength range.

It may be desirable for the apparatus to further include a camera positioned to acquire one or more images of a field of view and a processor comprising memory and analyzing software loaded thereon. The software is preferably capable of analyzing the one or more acquired images to determine the position of the center of a golf ball. Optionally, the golf ball may include one or more substantially circular markers, such as limited spectrum markers and the like.

It is desirable for the background surface to comprise a high grey level surface that emits a limited spectrum of light. The illumination device may include a filter or strobe lamp. Any type of camera may be used, although a camera comprising a CCD having at least about a four megapixel resolution is preferable. The camera may include a filter to prevent light within predetermined wavelengths from being imaged.

According to another aspect, the present invention comprises a method for determining the kinematics of a golf object. The method includes acquiring an image of a field of view without a golf ball present and acquiring at least two images of a golf ball in motion within the field of view. The images are preferably based on one or more substantially circular markers that are included on the surface of the golf ball. After the images of the golf ball have been acquired, the image of the field of view is subtracted from each of the at least two images of the golf ball in motion. The location of a circular perimeter of the golf ball for each of the at least two images after the image of the field of view is subtracted may then be determined.

In one embodiment, the method also includes analyzing the circular perimeter in each of the at least two images to determine a position of the center of the golf ball in each image. The kinematic characteristics of the golf ball based on the substantially circular markers and the center of the golf ball in each of the at least two images may then be determined. A processor comprising a memory and software loaded thereon may be used to perform the subtracting and determining. Based on these steps, the kinematic characteristics of a golf ball such as side spin, back spin, trajectory, velocity, launch angle, and side angle may be calculated.

In yet another embodiment, the present invention comprises an apparatus for determining the kinematics of an object that includes an illumination device selectively positioned to illuminate a field of view with light within a predetermined wavelength range, a golf ball having a surface that absorbs light within the predetermined wavelength range, and a background surface that reflects the light within the predetermined wavelength range. The background surface may comprise a high grey level surface in some embodiments. It may be desirable for the apparatus to also include a camera positioned to acquire one or more images of a field of view and a processor comprising memory and analyzing software loaded thereon. The software is preferably capable of analyzing the one or more acquired images to determine the position of the center of a golf ball.

BRIEF DESCRIPTION OF THE DRAWINGS

Further features and advantages of the invention can be ascertained from the following detailed description that is provided in connection with the drawings described below.

DETAILED DESCRIPTION OF THE PREFERRED EMBODIMENTS

Figure 1:
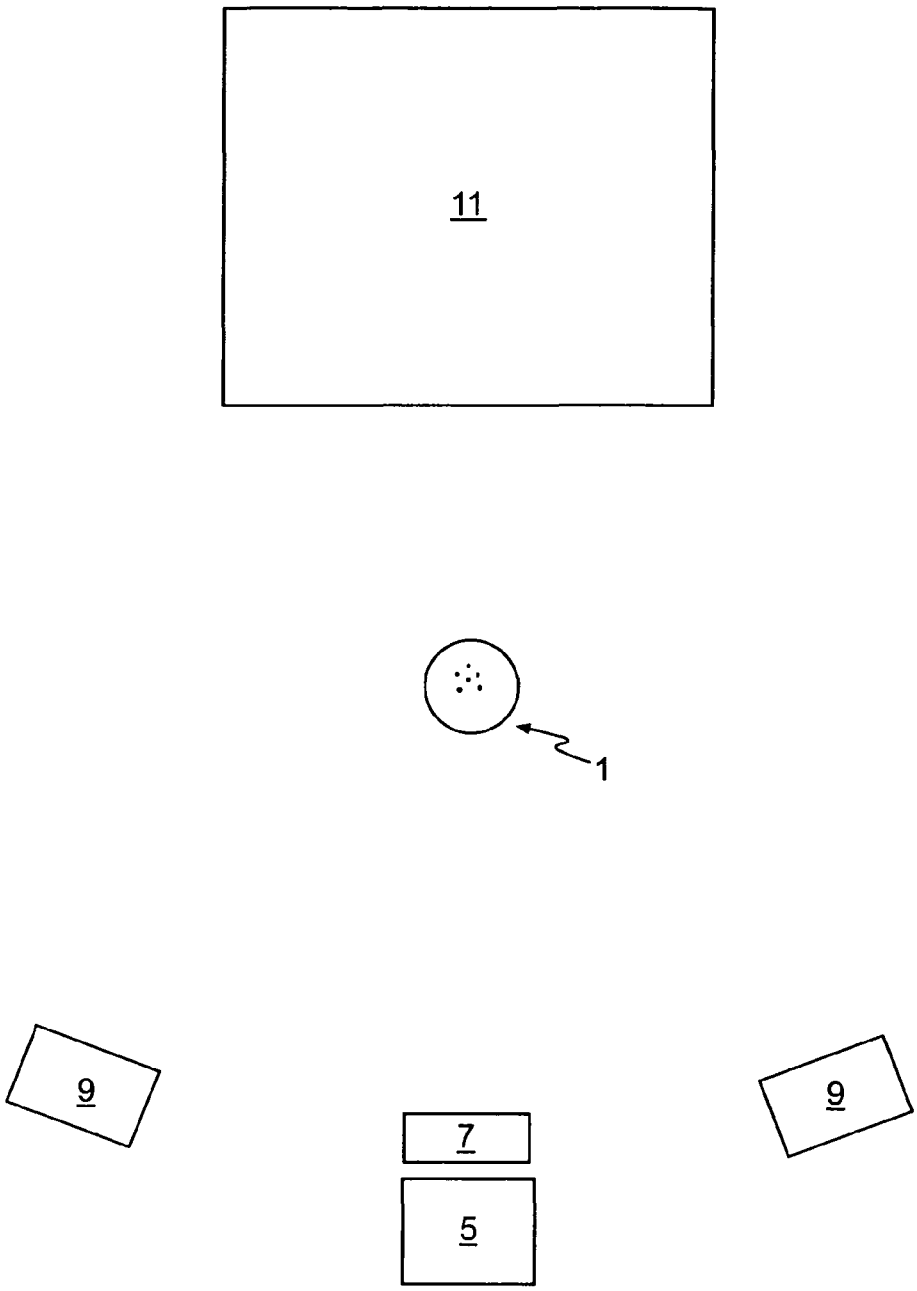
FIG. 1 is a diagram showing an exemplary apparatus for acquiring images based on positive imaging.

Other than in the operating examples, or unless otherwise expressly specified, all of the numerical ranges, amounts, values and percentages such as those for amounts of materials, spin, diameter, velocity, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Competitive athletes will take advantage of any tool that can help them fine-tune the individual aspects of their game. Many times in golf, the key to perfecting a player's game is the selection of equipment that optimally fits his or her specific swing characteristics. Thus, a competitive golfer is constantly searching for tools that enable him or her to observe and analyze his or her swing and the resultant trajectory of the golf ball that is achieved using a variety of different equipment. By doing so, a player can make the adjustments necessary to optimize his or her swing, which may ultimately lead to a better score.

In other applications, it is desirable to determine the aerodynamic characteristics of a golf ball by determining the spin and velocity of the golf ball. Typically, devices referred to as launch monitors are used to analyze a player's swing and resultant ball trajectory. The launch monitor typically includes an imaging system that is capable of imaging dynamic events such as the motion of a club, ball, or the golfer's body. The image may include one or more image frames, and is usually based on markers placed on the surface of the golf ball. The image or images may then be analyzed using a desired mathematical algorithm that enables the kinematic characteristics of the club or ball to be determined.

Because mathematical algorithms are used to determine the kinematic characteristics, launch monitor manufacturers are constantly searching for improved algorithms that will provide more accurate and precise calculations. In the past, manufacturers have been able to increase the accuracy of their measurements by changing the size, number, or orientation of the markers that are placed on the surface of the golf ball. Alternately, manipulation of the type of markers, imaging equipment, or illumination sources that are used have resulted in an increased accuracy.

The present invention relates to a method and apparatus that further increases the accuracy of the calculations used to determine the kinematic characteristics of a golf ball. In particular, the present invention relates to a method and apparatus that is capable of determining the location or position of the center of the golf ball based on acquired images. Moreover, the present invention is capable of determining the position of the center of the golf ball based on the location of the circular perimeter of the ball. As is discussed in more detail below, the location of the circular perimeter of the golf ball may be determined based on image subtraction and a high contrast background.

The present invention may be used in combination with any launch monitor, which are well known to those skilled in the art. Examples of launch monitors with which the present invention may be combined include, but are not limited to, those described in U.S. patent application Ser. Nos. 10/861,443, 10/929,400, 10/898,584, and U.S. Pat. Nos. 5,471,383, 6,758,759, and 6,781,621, the entireties of which are incorporated by reference herein. Those skilled in the art will recognize that these are only examples of the many launch monitors currently available. The present invention is not intended to be restricted to any particular type of launch monitor, and is capable of being used in combination with launch monitors having any desired characteristics. For instance, the present invention may be used with launch monitors having any number or type of cameras, processors, triggers, lighting units, background surfaces, filters, and the like.

Some launch monitors include only a single camera to monitor either the club, the ball, or both. Other launch monitors include two or more cameras. In embodiments that employ two or more cameras, one or more cameras may be positioned to monitor the flight of the golf ball while one or more other cameras may be positioned to monitor the path of the golf club. In other embodiments, two or more cameras may be positioned to acquire images of different fields of view. In such an embodiment, the fields of view may overlap by a predetermined amount. The present invention is capable of being used in combination with launch monitors having any number of cameras. That is, the present invention may be used in combination with one camera systems, two camera systems, or systems that employ multiple cameras.

In one embodiment, the launch monitoring system may be used with a golf ball that includes markers positioned on the surface. Any number of markers may be used. Preferably, the markers are oriented such that they are all visible to an imaging system, which may comprise one or more cameras. The markers may comprise a retroreflective material, such as the "Scotchlite" brand. Alternately, the markers may comprise limited spectrum markers, such as fluorescent markers. Limited spectrum markers are capable of responding to a first excitation wavelength by emitting a second wavelength or wavelengths. In order to prevent unwanted light from being imaged, the emitted wavelengths may pass through a filter that is operatively connected to, or part of, an imaging system.

The orientation, size, and shape of the markers may be varied as desired. In one embodiment, the markers are substantially circular. In other embodiments the markers may be square, triangular, rectangular, hexagonal, irregular, and the like. Preferably, the substantially circular markers have a diameter between about 0.02 inches and about 0.40 inches. More preferably, the substantially circular markers have a diameter between about 0.05 inches and about 0.35 inches. Most preferably, the substantially circular markers have a diameter between about 0.07 inches and about 0.25 inches.

Any number of markers may be used. Preferably, four or more markers may be used. More preferably, five or more markers may be used. Most preferably, six or more markers may be used. According to an exemplary embodiment, six markers are positioned on the surface of the golf ball. In this embodiment, five of the markers are placed at the vertices of a pentagon and the sixth marker is placed substantially at the center of the pentagon.

The markers may be placed on the surface of the golf ball in any manner known to those skilled in the art. In one embodiment, the markers are placed onto the surface of the ball based on pad printing. However, in other embodiments the markers may be painted, glued, or otherwise attached or placed on the surface of the golf ball.

Many launch monitoring systems require calibration periodically. However, other launch monitoring devices are capable of functioning with a minimal amount of calibration. As discussed in U.S. Pat. No. 5,471,383, incorporated by reference above, the need for a calibration fixture may be substantially reduced or eliminated by precisely positioning markers on the surface of the golf ball. Thus, it may be desirable to precisely position the markers on the surface of the ball using a pad printing process in order to minimize the amount of calibration that is necessary.

In one embodiment, the present invention comprises an imaging unit, such as a camera and the like. The present invention may also include, for example, a housing, a processing device, a trigger, one or more illumination devices, one or more reflective devices, a memory with software loaded thereon, and the like. It may be desirable for at least some of the elements of the present invention to be operatively connected.

The camera may be analog or digital. Preferably, the camera is digital and comprises a light sensitive sensor with either a CMOS or CCD pixel array. Preferably, the camera has at least about a four megapixel resolution. (2044(V)×2008(H)). More preferably, the camera has at least about a five megapixel resolution. Most preferably, the camera has at least about a seven megapixel resolution. The camera is preferably capable of acquiring black and white images or color images. In one embodiment, black and white cameras have a grey level range typically from 0 to 255. According to one aspect, the cameras of the present invention may be used to determine the kinematic characteristics of a golf ball as described in U.S. Pat. No. 6,285,445, the entirety of which is incorporated by reference herein.

As described in more detail below, the launch conditions of the ball such as the components of velocity and spin rate may be determined according to mathematical algorithms. The launch conditions are preferably calculated from images transmitted to the computer from the one or more cameras. Preferably, the computer includes a processor and a memory. The processor is preferably capable of executing computer program instructions. The computer program instructions may be bundled as a software package that is loaded onto the computer memory. The present invention preferably includes computer software that is capable of computing the kinematic characteristics of the ball flight by predetermining the lift and drag forces of a particular golf ball based on aerodynamic tests.

As mentioned above, the present invention is capable of increasing the accuracy of the calculations involved in determining the launch characteristics of a golf ball. In one embodiment, this is preferably accomplished based on determining the location of the circular perimeter of the ball. Based on the location of the circular perimeter of the ball, the position of the center of the ball may be determined. Knowing the location of the center of the ball aids in calculating the launch characteristics of the golf ball, as described in more detail below.

In one embodiment, the location of the circular perimeter of the ball may be determined based on performing an edge analysis of acquired images of the ball. In this embodiment, an image of the background is acquired. The background image preferably comprises an image of the field of view of the camera while the golf ball is not present. One or more images of the ball may then be acquired. It may be desirable for a first image to comprise the golf ball immediately after it has been struck by a club, while a second image comprises the ball in flight shortly thereafter. After the one or more images of the ball have been acquired, the background image may be subtracted from the images of the ball. Subtracting the background image from the images of the ball helps to improve the contrast between the ball perimeter and the background. The image with the background subtracted may then be analyzed using the computer to determine the location of the circular perimeter of the ball.

The location of the circular perimeter of the golf ball may be determined based on positive or negative imaging. As used herein, positive imaging comprises acquiring images of the golf ball based on light originating from in front of the golf ball. Negative imaging, on the other hand, involves light originating from behind the golf ball. The "front" of the golf ball, as used herein, will be understood to be the portion of the golf ball facing the one or more imaging units. Conversely, the "back" of the golf ball, as used herein, will be understood to be the portion of the golf ball facing away from the one or more imaging units. It may be desirable to provide the lighting from a variety of angles and/or elevations with respect to the front or back of the golf ball.

Figure 2:
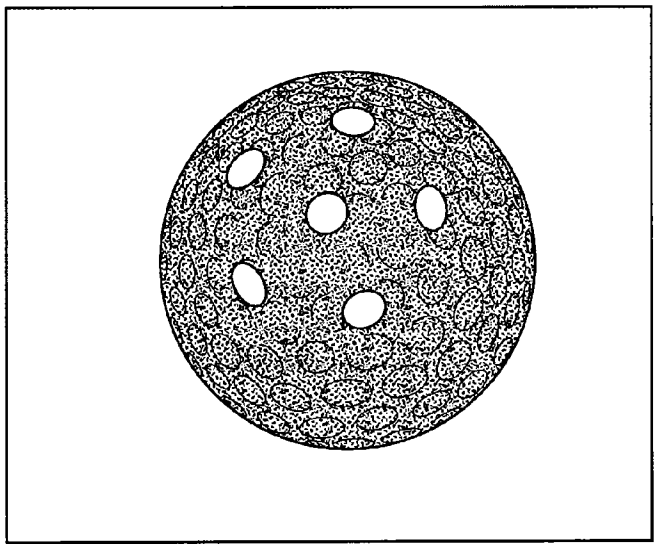
FIG. 2 is a diagram showing an exemplary image acquired based on the FIG. 1 apparatus.

Turning now to FIGS. 1 and 2, an exemplary apparatus used to determine the circular perimeter of the golf ball based on positive imaging is discussed. As shown in FIG. 1, a golf ball 1 may pass through the field of view of a camera 5. The camera 5 may include a light source 7, such as a strobe lamp, ring lamp, or the like. In addition, one or more illumination devices or light sources 9, such as strobe lamps, ring lamps, or light emitting diodes (LED's), may be positioned near or around the camera 5. Preferably, the light sources 9 are operatively connected to the camera 5. Although the camera 5 and strobes are shown as separate elements, it will be understood by those skilled in the art that the strobes and cameras are operatively connected and may comprise elements included in a launch monitor. As such, the cameras and strobes may be operatively connected to a plurality of other elements, and may be partially or wholly enclosed in a housing. The housing may include other elements, each of which may be operatively connected to each other.

In one embodiment, it is also desirable to position a background surface 11 behind the golf ball so that is silhouettes the outline of the golf ball. The background surface preferably absorbs or reflects light within a predetermined wavelength range. When the background surface absorbs light, a golf ball having a surface that reflects the light within the same predetermined wavelength range is desirable. However, when the background surface reflects light, a golf ball having a surface that absorbs the light within the same predetermined wavelength is desirable. The golf ball may optionally include markers on its surface that are capable of either reflecting or absorbing light within the predetermined wavelength.

In one embodiment, the background surface comprises a high grey level surface 11 that reflects the strobe light so that it silhouettes the outline of the golf ball. One example of a high grey level surface that may be used is manufactured by Riverside Paper Company, and is marketed under the name NEON PAPER. The high grey level surface 11 is preferably positioned within the field of view of the camera 5. The high grey level surface may comprise, for example, a reflective surface, diffuse material, and the like. One advantage of the background surface 11 being positioned behind the golf ball is that the contrast between the circular perimeter of the golf ball and the background may be increased, allowing the location of the circular perimeter to be more easily determined. One example of an image that may be acquired based on the background surface 11 is shown in FIG. 2. Although the background surface may be chosen to reflect or absorb any color, or combination of colors, it is preferred that the background surface is capable of responding to a blue excitation spectrum by emitting orange light.

In such an embodiment, one or more strobe lamps 9 may be selectively positioned such that they are capable of directing light towards the field of view. The strobe lamps 9 may be capable of generating white light. Thus, the strobe lamps 9 preferably include a filter that only allows light within a range of predetermined wavelengths to pass. In one embodiment, the strobe lamps 9 include a filter that allows only light within the blue spectrum (approx. 450-500 nm) to pass. Alternately, it may be desirable for the strobe lamps to include light emitting diodes (LED's) that are capable of generating blue light without the use of filters.

The strobe lamp 7 functions in a similar manner to the strobe lamps 9. The strobe lamp 7 may generate white light, and may include a filter that only allows light within predetermined wavelengths to pass. The strobe lamp may be positioned and directed such that it directs light towards the field of view. In embodiments where the strobe lamp 7 generates white light, it is desirable for the lamp to include a filter. The filter preferably allows only light within a predetermined spectrum, such as the blue spectrum, to pass. This is just one example, however. In other embodiments, the filter may be chosen such that any desired wavelength or range of wavelengths may pass. The wavelengths that are allowed to pass may depend on, for example, the excitation spectrum and/or the emission spectrum of the markers. As mentioned above, a strobe lamp comprising LED's that generate light within a desired wavelength may be used without a filter.

In one embodiment, the surface of the golf ball includes fluorescent markers. The fluorescent markers preferably respond to a blue excitation spectrum by emitting, for example, light within the orange spectrum. In other embodiments, the golf ball may include other markers, such as retroreflective markers and the like. Alternately, a combination of fluorescent and retroreflective markers may be desirable.

In a preferred embodiment, the camera 5 is able to take multiple images of the golf ball in flight, which may be analyzed to determine its launch characteristics. This may be accomplished using a variety of methods. Preferably, a multiframe method may be employed. This method is well known to those skilled in the art, and involves one ball image in different frames with a high speed camera.

More preferably, a method that uses multiple strobing or shuttering in a single frame may be used. In one example of such a method, the shutter of the camera is maintained in an open position for a desired period of time. While the shutter is open, the CCD of the camera is maintained in an activated state, so that the camera is able to acquire multiple images on the same frame. This method is analogous to using an analog camera that uses film with low sensitivity and maintains the shutter of the cameras in an open position. Because the shutter is continuously open, multiple front images may be acquired on the same frame, but directed lighting is preferably used so that the first strobed image of the ball does not get distorted or erased. In sunlight, this method can create poor images due to sunlight bleaching the strobed images.

Most preferably, a multishutter system is employed. An example of a multishutter system is the Pulnix TM6705AN camera, which is described in U.S. Pat. No. 6,533,674 and incorporated herein by reference. The Pulnix TM6705AN camera is a square pixel, VGA format, black and white full frame shutter camera. The camera features an electronic shutter that allows the camera to take multiple shutter exposures within a frame to capture high speed events. The camera has a small, lightweight, rugged design, making it ideal for portable systems. In a multishutter system, the camera shutters by activating and deactivating the pixel elements of the Charge Coupled Device (CCD) sensor. The camera also includes a CCD which may be selectively activated. At desired intervals, the CCD of the camera may be activated and deactivated in order to acquire images on the same frame. A multishutter camera allows multiple images to be acquired in one frame while minimizing the amount of background noise due to ambient lighting.

The camera 5 preferably includes a filter that only allows light within a predetermined wavelength range to be imaged. As described above, the background surface 11 and the markers on the surface of the golf ball may be chosen such that they are capable of responding to a blue excitation spectrum by emitting orange light. In such an embodiment, it is desirable for the camera to include a filter that is capable of only allowing orange light to pass. The filter therefore prevents any light not within the orange spectrum from being imaged. One example of an image acquired by a camera including such a filter is shown in FIG. 2. As shown in the figure, the background surface 11 and the fluorescent markers on the surface of the golf ball are visible in the picture. However, light reflected by the other portions of the golf ball is filtered, and as a consequence appears to be dark in the image.

With respect to one aspect of the present invention, an exemplary method of determining the aerodynamic characteristics of a golf ball based on positive imaging is described. A golf ball is preferably propelled using a propulsion device. The propulsion device may include an air cannon and air reservoir. Alternately, the propulsion device may comprise a ball launcher, such as the Ultra Ball Launcher manufactured by Wilson Sporting Goods. Preferably, the propulsion device is capable of propelling a golf ball at any desired, speed, spin, trajectory, and the like. The propulsion device may be used in applications where it is desirable to fire the golf ball at a known velocity and/or spin to determine the accuracy of the measurements according to the present invention. In other applications, the golf ball may be propelled in any desirable manner. This may include, but is not limited to, a golfer striking the golf ball with a golf club.

Before the golf ball is propelled from the propulsion device, at least one imaging unit acquires an image of the field of view (a background image). The image is preferably acquired by illuminating the field of view using the strobe lamps 9, shown in FIG. 1. The strobe lamps either generate, or are filtered to pass, light within a limited spectrum. The background surface 11 preferably responds to this limited spectrum by emitting light within its excitation spectrum. The camera 5 preferably includes a filter that is capable of preventing light that is not within the emission spectrum from being imaged.

After the background image is acquired, the propulsion device preferably propels the golf ball. A triggering device may be used to determine the speed of the golf ball. Triggering devices are well known, and may be based on light or sound. Alternately, the computer may be operatively connected to both the propulsion device and the one or more cameras 5 and may determine the interval between camera images without the use of a trigger. However, in embodiments where triggering devices are used to determine the interval between camera images, the triggering device is preferably operatively connected to the camera 9. As desired according to a particular application, two or more images of the golf ball in motion, within the field of view, are preferably acquired. Once the images of the golf ball have been acquired, a processor is preferably capable of running a software program that is able to subtract the background image from the images of the golf ball in motion. As described in more detail below, the subtracted images may be used to determine the location of the circular perimeter of the golf ball. Once the location of the circular perimeter of the golf ball has been determined, the location of the center of the golf ball may be calculated.

Figure 3:
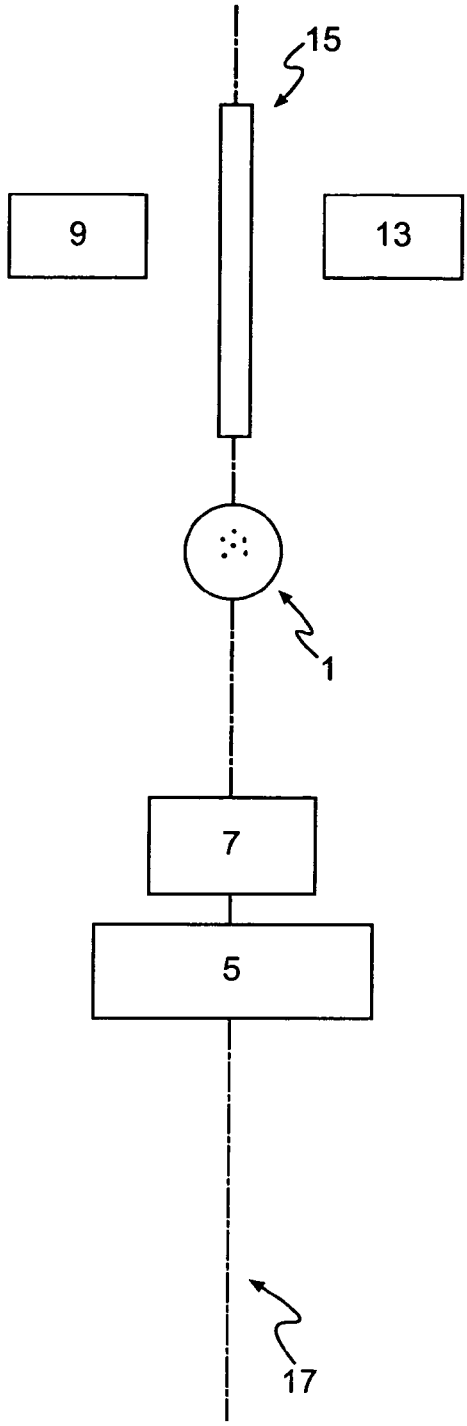
FIG. 3 is a diagram showing an exemplary apparatus for acquiring images based on negative imaging.

Turning now to FIG. 3, an exemplary apparatus used to determine the location of the circular perimeter of the golf ball based on negative imaging is discussed. In this exemplary embodiment, a golf ball 1 may pass through the field of view of camera 5. The camera 5 may include a strobe lamp 7 that illuminates the field of view. Though only a camera and strobe are illustrated in FIG. 3, those skilled in the art will understand that they may be elements included in a launch monitor. Other elements, though not shown in FIG. 3, may be operatively connected to the camera and/or the strobe. The exemplary apparatus also includes at least two strobes 9, 13 that are selectively positioned behind the golf ball 1 and out of the field of view. Preferably, a divider 15 is selectively positioned between the two strobe lamps 9, 13. The divider is also positioned outside of the field of view. The divider 15 may be configured and dimensioned such that it is capable of substantially minimizing light from either strobe 9, 13 from passing plane 17.

In one embodiment, the strobe 7 and camera 5 function in a substantially similar manner as described with respect to FIG. 1. Thus, the strobe 7 is positioned such that it is capable of illuminating the markers positioned on the golf ball 1 and the camera 5 is positioned such that it is capable of acquiring images of objects within the field of view. The camera 5 preferably includes a filter, as described with respect to FIG. 1. This embodiment differs from the FIG. 1 embodiment, however, because two or more strobe lamps 9, 13 are selectively positioned behind the golf ball 1. The two strobe lamps 9, 13 are preferably capable of backlighting the golf ball such that the location of the circular perimeter may be determined from images acquired by the camera 5.

In one embodiment, the strobe lamps 9, 13 may be capable of generating white light. In such an embodiment, the strobe lamps 9, 13 may include filters that only allow light within a predetermined wavelength to pass. In one embodiment, the camera 5 preferably includes a filter that only allows orange light to be imaged. Thus, it may be desirable for the strobe lamps 9, 13 to generate orange light. Preferably, the strobe lamps 9, 13 are positioned such that they are capable of illuminating the golf ball. The strobe lamps 9, 13 may alternately comprise LED's that are capable of generating orange light without the aid of filters.

In order to avoid bleaching of acquired images, the strobe lamps 9, 13 are preferably separated by a divider 15 that is capable of substantially minimizing light from passing plane 17. In one embodiment, strobe 9 is activated shortly after the golf ball enters the field of view. The second strobe 13 may then be activated shortly thereafter. The divider 15 is preferably positioned such that the light generated by strobe 13 does not bleach the first acquired image of the ball. Another way to prevent bleaching of the first image of the ball is to position the strobe lamps 9, 13 at angles such that they do not cause bleaching of the first image. In one embodiment, this may be effected by positioning strobe 9 such that the light it generates is directed across the plane 17. Positioning the strobe 9 in this manner allows the light to be focused on the golf ball as it enters the camera's field of view, while substantially minimizing the light that is directed toward the area of the camera sensor that will acquire the second image of the golf ball. In this embodiment, the divider 15 may optionally be included, but is not required.

With respect to the negative imaging apparatus described above, an exemplary method for determining the aerodynamic characteristics of a golf ball is discussed. Before a golf ball is launched into the field of view of the one or more cameras, a background image is preferably acquired. In one embodiment, the background image is preferably acquired without any illumination. Unlike the positive imaging apparatus described above, the negative imaging apparatus does not include a background surface. Thus, illumination is not necessary to acquire a background image.

Figure 4:
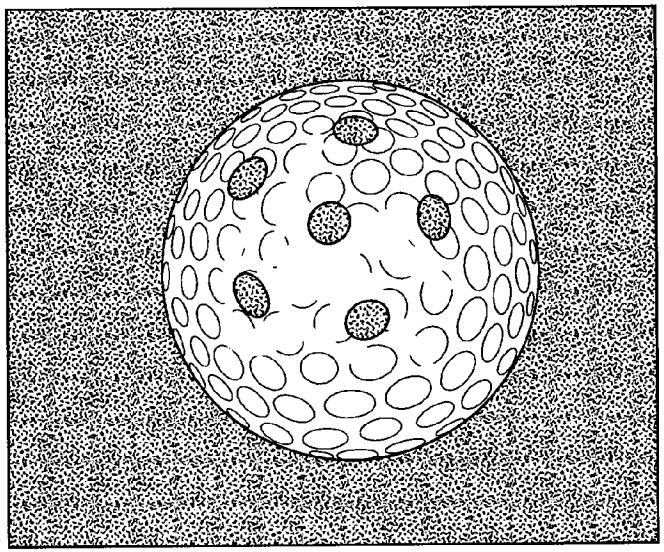
FIG. 4 is a diagram showing an exemplary image acquired based on the FIG. 3 apparatus.

After the background image has been acquired, the golf ball may be propelled through the field of view. It is desirable for the camera 5 to acquire at least two images of the golf ball in motion, while it is within the field of view. While the golf ball is in flight, strobes 9 and 13 preferably activate at desired intervals in order to aid in acquiring images of the golf ball. Once the images of the golf ball in motion are acquired, the background image may be subtracted from the images of the ball in motion. The location of the circular perimeter and the center of the golf ball may then be determined, as described in more detail below. An exemplary image acquired in this manner is shown in FIG. 4.

Though the exemplary embodiments with respect to FIGS. 1-4 are described in terms of a single camera arrangement, those skilled in the art will understand that more than one camera may be used. Specifically, a two camera system may be used that is capable of acquiring images of the golf ball in two positions. In this embodiment, a first camera may be positioned to acquire an image of the golf ball immediately after it is launched. The second camera may be positioned such that it is capable of acquiring an image of the golf ball shortly thereafter. Other embodiments may include more than two cameras. In these embodiments, two cameras may be capable of monitoring the flight of the golf ball while the other two cameras may be capable of monitoring the motion of, for example, a golf club.

As mentioned above, the present invention may comprise a one camera system in some embodiments. It is desirable for the camera to include a sensor panel, such as a CCD or the like, that is capable of acquiring images. According to one aspect, the sensor panel is preferably aligned with the golf ball such that the normal to the sensor panel is perpendicular to gravity and its orientation is parallel to the downrange direction of the intended flight of the golf ball. Such an alignment may be effected by, for example, bubble balancing the camera or using a tilt and roll sensor.

After images of the golf ball and the background have been acquired, as described above, the edge points of the ball measured in pixel space may be used to determine the location of the image center of the ball. In one embodiment, the location of the image center may be determined by solving the equation of a circle with three unknown parameters xc, yc, and R in, for example, the equation:

$$(x-x_c)^2+(y-y_c)^2=R^2$$

in which $x_c$ and $y_c$ are the pixel coordinates of the center of the imaged ball and R is the radius of the circle of the imaged ball. The edge points are x and y, as measured from the edge detection algorithms. A preferred edge detection algorithm is the Shen-Castan algorithm provided in the software program sold by Matrox Electronics System, Ltd.

Figure 5:
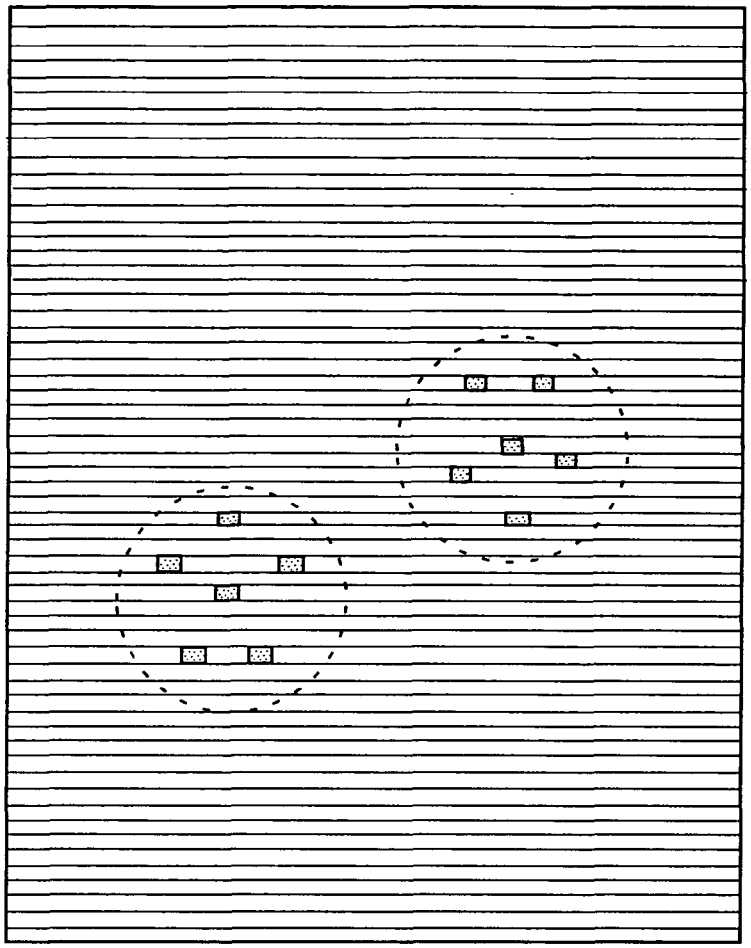
FIG. 5 is a diagram illustrating exemplary image segments.

According to one embodiment, it is desirable to determine location of the center of each of the circular markers in order to determine the launch characteristics of the ball. The location of the center of each of the circular markers A-F may be determined based on a centroid averaging procedure. In one embodiment, a centroid averaging procedure called run length encoding (RLE), which is well known to those skilled in the art, may be used. In performing such a centroid averaging procedure, the center position of the highly contrasted markers may be determined by summing all of the pixels from a given marker that have an intensity level above or below a threshold gray level, and then dividing by the number of pixel elements in the sum. The thresholding operation segments the image into distinctly contrasted regions with circular ball edges, as illustrated by FIG. 5.

If the center of each of the circular markers is represented by U, V, the photogrammetric equations for a one camera system relating the calibrated x, y, and z coordinates of the markers with the U, V image coordinates are, for example, given as follows for one imaged ball:

$$U(j)=f[x(j)/z(j)] \text{ and } V(j)=f[y(j)/z(j)]\ j=1 \text{ to } 6;$$

where "f" is the focal length of the camera lens.

In the equation above, the symbol "f" represents the focal length of the camera lens. In addition since the center of the imaged ball is known by outlining the image of the ball, this gives the additional two equations relating the image center (ucenter, vcenter) to the center of mass position of the ball (Tx, Ty, Tz) through the two photo equations $$u_{center}=f[T_x/T_z] \text{ and } v_{center}=f[T_y/T_z]$$

In writing the equations above for computational solution, it is best to represent the X, Y, Z coordinates of each marker by its center of mass location Tx, Ty, and Tz and its angular orientation matrix about this body coordinate axis with angles A, E, and T. The position of each marker j=1, 2, . . . 6 in coordinate space may be represented, for example, by the matrix:

$$\begin{pmatrix} X_c(j) \\ Y_c(j) \\ Z_c(j) \end{pmatrix} = \begin{pmatrix} T_x \\ T_y \\ T_z \end{pmatrix} + M(A, E, T) \begin{pmatrix} 0.84\sin\theta(j)\cos\phi(j) \\ 0.84\sin\theta(j)\sin\phi(j) \\ 0.84\cos\theta(j) \end{pmatrix}$$

in which the orientation matrix is:

$$M(A, E, T) = \begin{bmatrix} M_{11} & M_{12} & M_{13} \\ M_{21} & M_{22} & M_{23} \\ M_{31} & M_{32} & M_{33} \end{bmatrix}$$

The orientation matrix, M, gives the three-dimensional orientation transformation connecting the body coordinates of the ball with the camera reference coordinate system. The column vectors (0.84 sin θ(j) cos Φ(j), 0.84 sin θ(j) sin Φ(j), 0.84 cos θ(j), give the position of the $j^{th}$ marker in the body fixed coordinate system. The optimum arrangement of markers A-F is one at 0°, 0° and the five surrounding markers at θ(j)=37° and Φ(j)=0°, 72°, 144°, 216°, 288°. An angle of theta much greater than 50° will not allow all six (6) markers on the ball in the optimum configuration of the system to be captured on severely hooked or sliced golf shots.

The resulting equations to be solved given the camera coordinates, $U_{(j)}$, $V_{(j)}$, for the six markers, j, are as follows, and i=1,6 and j=1,6:

$$U(j) = f\left[\frac{T_x + M_{11}X_B(j) + M_{12}Y_B(j) + M_{13}Z_B(j)}{T_Z + M_{31}X_B(j) + M_{32}Y_B(j) + M_{33}Z_B(j)}\right]$$

$$V(j) = f\left[\frac{T_y + M_{21}X_B(j) + M_{22}Y_B(j) + M_{23}Z_B(j)}{T_z + M_{31}X_B(j) + M_{32}Y_B(j) + M_{33}Z_B(j)}\right]$$

in which $X_B(j)$, $Y_B(j)$ and $Z_B(j)$ are the Cartesian coordinates represented earlier as spherical polar coordinates that describe the body coordinate position of the $j^{th}$ marker.

The resulting fourteen equations are solved for $T_x$, $T_y$, $T_z$ and orientation angles A, E, T for the ball's first location, A. A similar set of fourteen equations is solved for the second location position of the ball, B. The fourteen equations are nonlinear and are solved iteratively by using a linearization of Taylor's theorem. Generally, the equations converge to a solution for the six unknown parameters in eight iterations.

The velocity components of the ball along the three axes of the coordinate system are then computed from the formulas, for example:

$$V_x = \frac{T_x(t+\Delta T) - T_x(t)}{\Delta T}$$

$$V_y = \frac{T_y(t+\Delta T) - T_y(t)}{\Delta T}$$

$$V_z = \frac{T_z(t+\Delta T) - T_z(t)}{\Delta T}$$

in which ΔT is the time interval between strobe firings.

The spin components result from multiplying the orientational matrix $M^T(A,E,T,t)$ and M(A', E', T', t+ΔT) and equating the off-diagonal elements of the resulting relative orientation matrix, for example:

$$A(t,t+\Delta T)=M(t+\Delta T)M^T(t)$$

Then the magnitude θ of the angle of rotation vector of the two balls during the time increment ΔT is given by, for example:

$$\theta=\sin^{-1}(R/2)$$

where $$R=\sqrt{L^2+M^2+N^2}$$

$L=A_{32}-A_{23}$
$M=A_{13}-A_{31}$
$N=A_{21}-A_{12}$

The three orthogonal components of spin rate, $W_x$, $W_y$, $W_z$ are given by, for example:

$$W_x=\sin^{-1}(R/2)L(R\Delta T)=\theta L(R\Delta T)$$

$$W_y=\sin^{-1}(R/2)M(R\Delta T)=\theta M(R\Delta T)$$

$$W_z=\sin^{-1}(R/2)N(R\Delta T)=\theta N(R\Delta T)$$

In the prior art, knowledge of the six ball marker positions resulted in twelve equations which included six unknowns. By providing knowledge of the center of the imaged ball, such as via the present invention, the six unknowns may be reduced to four unknowns. Because the number of unknowns is reduced, the accuracy of the launch conditions may be more accurately determined.

In order to quantify the increase in accuracy provided by the present invention, a statistical computer study was performed that compared the use of the six ball marker positions versus the use of the six ball markers positions and the additional knowledge of the location of the center of the circle in the image of the ball found from edge analysis of the outline of the ball. The simulation translates the center mark of the ball by about 950 pixels over the field of view.

In previous analysis of the image of the ball launch, the one camera system assumed six markers essentially at the vertices of a pentagon and one marker at the center of the pentagon. A computer simulation program was run to test the accuracy for random noise applied to the location of the centroids of these markers at various error levels. This center gives added knowledge of the actual center of mass of the ball Tx, Ty, Tz, since the image center is represented by the equations uc=f*Tx/Tz and vc=f*Ty/Tz. Essentially, the imaged center and the optical center form a line passing through the center of mass of the golf ball. Placing these additional equations in the algorithm for determining the ball's center of mass (tx, ty, tz) and orientation (a, e, t) angles from the image data resulted in improved accuracy in many of the launch variables. As mentioned above, the six unknown variables now become four unknowns because uc and vc are known.

A table of results is shown below. Table 1 shows data for a 0.2 pixel error, while Table 2 shows data for a 0.4 pixel error.

TABLE 1

| pentagon pattern with 30 degree marker location | old method (0.2 pixel error) Average (standard deviation) | new method (0.2 pixel error) |
|---|---|---|
| wxx spin (=100) | 109.0 (86.9) | 98.2 (11.2) |
| wyy spin (=200) | 207.2 (71.3) | 200.0 (11.5) |
| wzz spin (=3500) | 3499.0 (10.1) | 3498.2 (9.8) |
| velocity (=200) | 200.1 (.49) | 200.0 (.21) |
| launch angle (=10) | 9.98 (.16) | 10.0 (.02) |
| side angle (=5) | 5.07 (.52) | 5.0 (.55) |

TABLE 2

| pentagon pattern with 30 degree marker location | old method (0.4 pixel error) Average (standard deviation) | new method (0.4 pixel error) |
|---|---|---|
| wxx spin (=100) | 117.8 (174.9) | 98.8 (19.4) |
| wyy spin (=200) | 214.2 (144.2) | 202.9 (19.2) |
| wzz spin (=3500) | 3497.9 (20.1) | 3497.9 (16.0) |
| velocity (=200) | 200.2 (.98) | 200.1 (.42) |
| launch angle (=10) | 9.96 (.33) | 10.0 (.036) |
| side angle (=5) | 5.1 (1.1) | 5.0 (1.2) |

These exemplary results were generated using a spinrate wxx=100, wyy=200, and wzz=3500 with a velocity of about 200 feet per second, launch angle of about 10 degrees, and side angle of about 5 degrees. The speed and launch angle are greatly improved with the added knowledge of the center of the ball. This results in the nonlinear equations only requiring four unknown values versus six unknowns values (in the prior art). The use of the center of the ball image determination can also be used, for example, in a stereoscopic two camera system, an example of which is described in U.S. Pat. No. 5,471,383, which is incorporated by reference above.

In addition, the area of the whole ball image centroid can be incorporated into this algorithm to improve the side angle accuracy. If the radius of the two balls found from the circle fitting method described above differ, then the differing radii indicate that ball is moving away or toward the camera. Using this information, the present invention is capable of enhancing the accuracy in measuring the side angle.

Although some preferred embodiments have been described, many modifications and variations may be made thereto in light of the above teachings without departing from the spirit and scope of the present invention. It is therefore to be understood that the invention may be practiced otherwise than specifically described without departing from the scope of the appended claims.

The invention claimed is:

1. An apparatus for determining the kinematics of an object, comprising:

a camera positioned to acquire one or more images of a field of view, the camera including a filter;

an illumination device selectively positioned to illuminate a field of view using light within a predetermined wavelength range;

a golf ball having a surface that responds to the light to generate a camera image; and a background surface that absorbs the light within the predetermined wavelength range wherein an image of the background surface is subtracted from an image of the golf ball and used to determine a center of the golf ball.

2. The apparatus according to claim 1, further comprising a processor comprising memory and analyzing software loaded thereon, wherein the software is operable to analyze the one or more acquired images to determine a position of a center of a golf ball.

3. The apparatus according to claim 2, wherein the camera comprises a CCD having at least about a four megapixel resolution or greater.

4. The apparatus according to claim 1 , wherein the golf ball includes one or more substantially circular markers that absorb light and have a low grey level surface.

5. The apparatus according to claim 1, wherein the background surface comprises a low grey level surface.

6. The apparatus according to claim 1, wherein the background surface emits a limited spectrum of light.

7. The apparatus according to claim 1, wherein the illumination device includes a filter.

8. The apparatus according to claim 1, wherein the illumination device comprises a strobe lamp.

9. A method for determining the kinematics of a golf object, comprising:

acquiring an image of a field of view without a golf ball present;

acquiring at least two images of a golf ball in motion within the field of view, wherein the golf ball comprises one or more substantially circular markers;

subtracting the image of the field of view from each of the at least two images of the golf ball in motion; and determining the location of a circular perimeter of the golf ball for each of the at least two images after the image of the field of view is subtracted;

wherein the subtracting and the determining are performed by a processor comprising a memory and software loaded thereon.

10. The method according to claim 9, further including analyzing the circular perimeter in each of the at least two images to determine a position of a center of the golf ball in each image.

11. The method according to claim 9, further comprising determining the kinematic characteristics of the golf ball based on the substantially circular markers and the center of the golf ball in each of the at least two images.

12. The method according to claim 11, wherein the kinematic characteristics comprise at least one of side spin, back spin, trajectory, velocity, launch angle, and side angle.

13. An apparatus for determining the kinematics of an object, comprising:

a camera positioned to acquire one or more images of a field of view;

an illumination device selectively positioned to illuminate the field of view using light within a predetermined wavelength range;

a golf ball having a surface that absorbs light within the predetermined wavelength range; and a background surface that reflects the light within the predetermined wavelength range wherein an image of the background surface is subtracted from an image of the golf ball in order to determine a center of the golf ball;

wherein the subtracting and the determining are performed by a processor comprising a memory and software loaded thereon.

14. The apparatus according to claim 13, wherein the background surface comprises a high grey level surface.

15. The apparatus according to claim 13, wherein the illumination device comprises a strobe lamp.

16. The apparatus according to claim 13, wherein the camera includes a filter.

17. The apparatus according to claim 13, wherein the camera comprises about a 4 megapixel resolution or greater.

18. The apparatus according to claim 13, wherein the golf ball includes one or more substantially circular markers that comprise a high grey level surface.

* * * * *